United States Patent [19]

Hargreave

[11] Patent Number: 4,881,742

[45] Date of Patent: Nov. 21, 1989

[54] VOLLEYBALL TECHNIQUE TRAINER

[76] Inventor: Francis M. Hargreave, P.O. Box 1104, Quogue, N.Y. 11959

[21] Appl. No.: 271,032

[22] Filed: Nov. 14, 1988

[51] Int. Cl.[4] ..... A63B 69/00

[52] U.S. Cl. ..... 273/413; 273/26 E; 273/29 A; 273/411

[58] Field of Search ..... 273/413, 411, 26 E, 273/26 EA, 29 A

[56] References Cited

U.S. PATENT DOCUMENTS

| | | | |
|---|---|---|---|
| 2,140,411 | 12/1938 | Wood | 273/413 |
| 2,305,187 | 12/1942 | Neiden | 273/29 A |
| 2,606,025 | 8/1952 | Hornig | 273/413 |
| 4,720,112 | 1/1988 | Stettner et al. | 273/411 |
| 4,732,395 | 3/1988 | Halverson | 273/411 |

*Primary Examiner*—William H. Grieb

*Attorney, Agent, or Firm*—Kelly & Hulme

[57] ABSTRACT

An apparatus for assisting in the training of volleyball players. This apparatus is comprised of a means of supporting the apparatus at a predetermined height above a surface; an arm member rotatably mounted to said support means for rotation around a substantially horizontal axis; a volleyball; and a semi-rigid tether which suspends the volleyball from the arm member. The apparatus allows the user to practice the skills of serving, setting, passing and spiking in a repeatable and efficient fashion such that the skills may be learned and become a cognative response during an actual volleyball game.

8 Claims, 3 Drawing Sheets

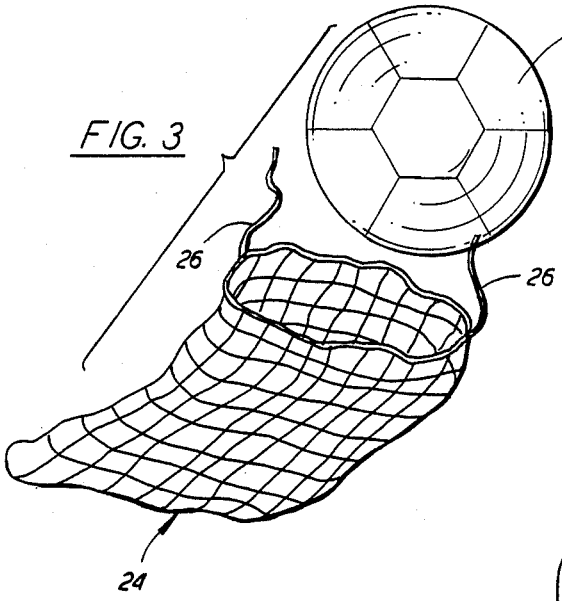
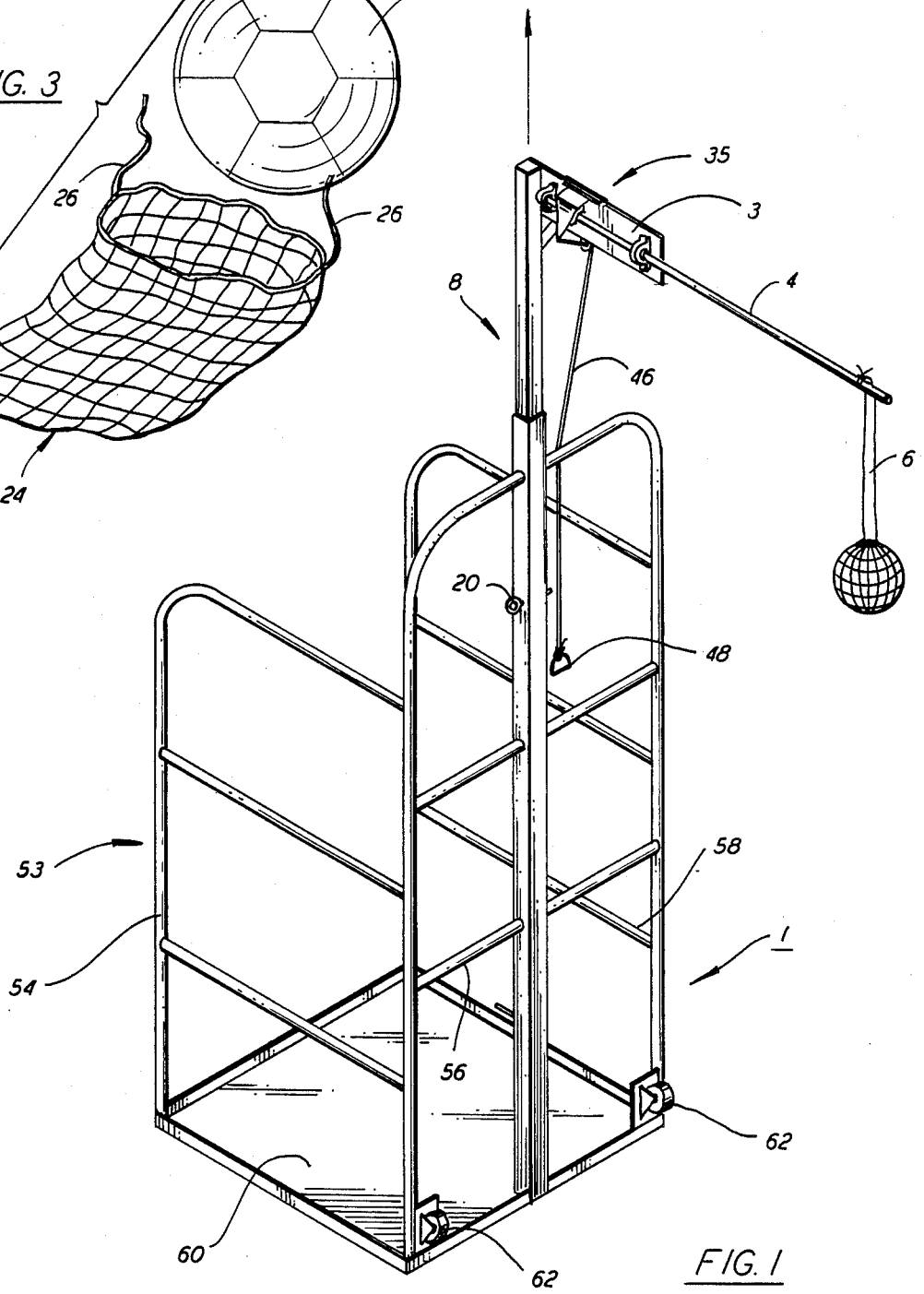
FIG. 1

VOLLEYBALL TECHNIQUE TRAINER

This invention relates to an apparatus useful in teaching a full range of techniques to players of Volleyball and other like sports.

BACKGROUND OF THE INVENTION

In general, the skills required for playing volleyball are serving (a method of throwing the ball and then hitting it over the net to start play), setting (a method of positioning on the ball to another player so that the other player may propel the ball across the net), passing (a method of moving the volleyball from one teammate to another teammate prior to moving the ball across the net), blocking (a method of preventing the opposing team from moving the ball back across the net) and spiking (a method of driving the ball with great energy into the opponent's side of the court).

As is well known, these skills are most often acquired by actual participation in the game of volleyball under game conditions and developing the skills by actually performing them in a game situation. However, in order to become more skilled in the game of volleyball, as is required when an individual advances from one skill level to the next, it is necessary to practice each of the skills considerably more often than is possible by actually playing the game itself in order to perfect the skills. In addition, to become truly skilled in the game of volleyball the above skills and techniques must become "second nature" such that a volleyball player's selection of any of these skills in an actual volleyball situation is on a cognitive or automatic level rather than something that the player has to consciously consider each time the player is engaged in the game of volleyball. In order to accomplish this goal, each of the techniques must be practiced and repeated a multitude of times.

Therefore, an apparatus which would assist a user to repeatedly and efficiently practice the above skills would be very useful in improving that user's skills. In addition an apparatus which would allow the user, or an individual coaching the user, to "take apart" each of the above skills such that the different features (such as hand position, arm velocity, leaping ability) could be worked on and analysed separately would also be very useful in teaching and improving those skills.

In addition, to attain any degree of excellence in playing volleyball or other like sports, proper form is extremely important and in order to attain that proper form, regular practice is required.

Furthermore, it is highly advantageous for a player to be able to practice under realistic, simulated conditions. In that way the player may repeat the different techniques necessary to participate in the game far more often than the opportunity to do so would be presented in the gamelike situation while closely approximating actual game conditions. Also, the ability to practice under simulated conditions allows a player to practice when neither the facilities nor the additional playing partners needed are unavailable.

One prior art apparatus for teaching volleyball techniques and skills is the subject of U.S. Pat. No. 3,897,950 ('950) which discloses an apparatus which holds a volleyball between two foam pads such that the user may place the ball in the apparatus and then strike it. While the '950 apparatus has some use in teaching blocking and spiking, it is not helpful in teaching the other above-described techniques necessary for playing volleyball.

In addition, after the ball inserted into the '950 apparatus is struck it must be retrieved. Finally, since the volleyball is not free moving when being used with the '950 apparatus, the '950 apparatus does not approximate actual game conditions.

Another known volleyball technique apparatus is the Spiking Practice Unit disclosed in SPORTIME® Products Catalog, 1987 Spring Summer edition, pg.72. This apparatus is comprised of a volleyball suspended from an adjustable stand; the ball being held in place by a breakaway VELCRO® sling. This apparatus suffers from some of the same problems as the '950 apparatus (e.g., the ball must be retrieved and reloaded after each hit) and, in addition, since the ball is suspended from a flexible sling, the ball height may change when struck, thereby making it difficult to repeat a technique which requires a repeatable ball height.

Finally, both the '950 apparatus and the Spiking Practice Unit present a safety risk to both the user and any passersby. When the ball used in these devices is struck, it moves away from and is no longer joined to the devices. The ball may, as a result, strike an unsuspecting passerby. In addition, the ball may ricochet off of a nearby object and roll back under the user's feet (who may still be in the air after having jumped up to strike the ball), thereby causing the user to fall and possibly be injured.

Therefore, an object of the present invention is to provide a volleyball technique training apparatus which may be used to teach a full range of volleyball skills.

It is another object of the present invention to provide an apparatus which allows for fast, efficient repetition of the particular skills being taught.

It is still another object of the present invention to provide an apparatus to teach proper hand techniques when striking or otherwise impacting a volleyball.

It is yet another object of the present invention to provide an apparatus that simulates the free moving nature of a volley ball in a 'real game', while the ball moves in a controlled path.

It is still another object of the present invention to provide an apparatus which may be used by individuals having a full range of skill levels and physiological ages.

It is still another object of the present invention to provide an apparatus that allows an individual to closely monitor or otherwise coach the user of the apparatus without fear of injury and without interferring with the user.

It is yet another object of the present invention to provide an apparatus which may be used with minimal risk to passersby (and to a less extent, the user) of injury and which when not being used may be partially disassembled and stored away.

These and other objects will become apparent from the following description and claims in conjunction with the drawings which form a part of this disclosure.

SUMMARY OF THE INVENTION

In accordance with the present invention, a volley ball technique training apparatus is provided that is comprised of an arm member having a first end rotatably mounted to a support means which maintains the arm member at a pre-determined height above a surface, the arm member being supported such that the arm rotates about a substantially horizontal axis; and a volleyball or like object attached by a semi-rigid tether to a second end of said arm member.

In one embodiment of the present invention, the support means may be comprised of a set of pillow blocks and bearings mounted to a wall such that the arm may be suspended horizontally out from the wall. However, in a preferred embodiment the support means is comprised of a base member mounted on a surface having a post member attached to said base member, said post member extending above said surface. The post member most preferably is adjustable in nature. The post member may additionally be comprised of a coaching cage in which a coach may stand to safely observe and otherwise coach the user of the apparatus. Furthermore, the adjustable post member may be comprised of two or more telescopable post sections which allow for easy height adjustment and which further allow the volleyball, arm member and upper support means to be removed from the apparatus. This is important especially when the apparatus of the present invention is used in a school setting. In being able to remove the operable portion of the apparatus, there is little danger of injury due to unsupervised use of the apparatus and further the device will not be likely to attract attention from passersby when the operable sections are removed and safely stored away.

Finally, in a preferred embodiment of the present invention, braking means are provided so that the rotation of the arm member may be slowed or even stopped after the volleyball is hit.

BRIEF DESCRIPTION OF THE DRAWINGS

FIG. 1 is a perspective view of the VOLLEYBALL TECHNIQUE TRAINING APPARATUS of the present invention (N.B. - the volleyball 2 depicted in this drawing is not drawn to scale so that the details of the apparatus itself may be more readily seen);

FIG. 3 is an exploded, fragmentary view showing the volleyball and the net bag which is used to attach said ball to the apparatus of FIG. 1;

DETAILED DESCRIPTION OF THE PRESENT INVENTION

Figure 2:
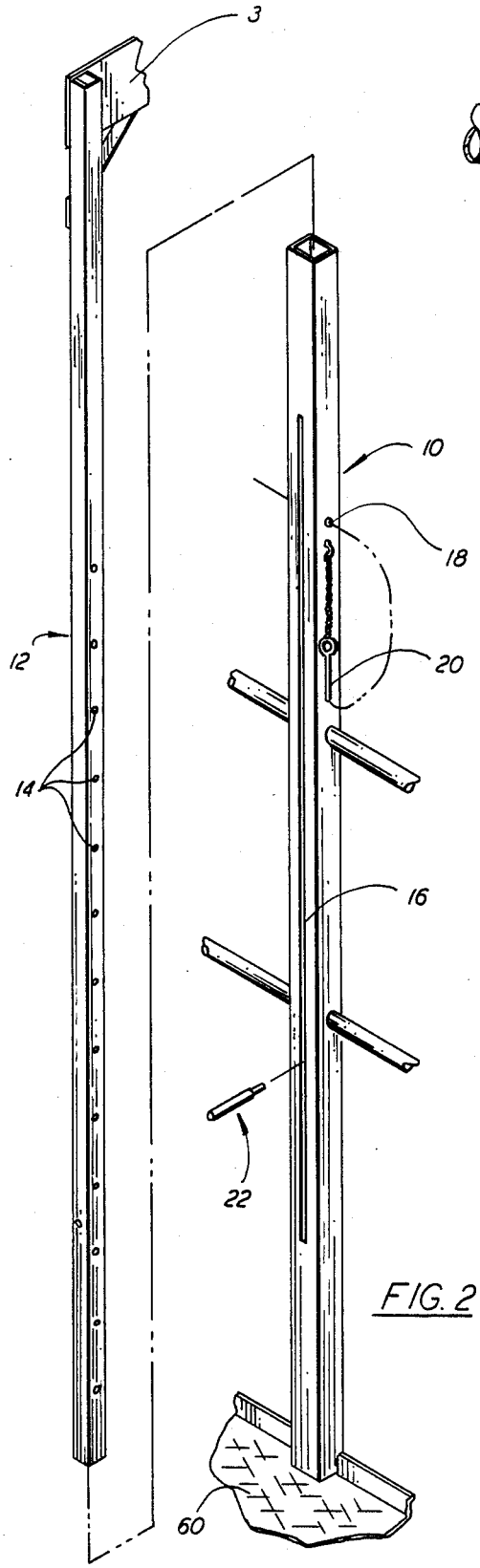
FIG. 2 is a fragmentary perspective view of the post member of the apparatus of FIG. 1.

As shown in the drawings, the preferred volleyball technique training apparatus 1 in accordance with the present invention, includes a base member 60 which may be formed from a rigid, strong molded plastic, a metal or other suitable material and which may be placed on a generally flat surface. The base member 60 must have sufficient weight either by itself or through the addition of weighted objects such as sand bags, a person or the like to prevent the apparatus 1 from overturning during the use thereof.

The base member 60 provides support for upright post member 8 which is fixed to said base member 60 and extends above the surface upon which base member 60 is placed. An upper end portion of upright post member 8 is provided with a mounting frame member 3 which receives one end of said arm member 4.

In a preferred embodiment, post member 8 is comprised of at least two sections, a lower section 10 having a first end joined to base member 60, and an upper section 12 having a first end receivable within the second end of the lower section 10 such that the height of the apparatus 1 of the present invention may be adjusted by "telescoping" upper section 12 into or out of lower post section 10.

In addition, a handle 22 is provided on upper post section 12 such that said section may be easily moved up or down within lower post section 10. The handle 22, which may be threaded into or otherwise fixed to upper post section 12, extends out of a slot 16 provided in lower post section 10 such that a user of the apparatus 1 may readily slide upper post section 12 up and down within lower post section 10.

Upper post section 12 further defines a series of openings 14 which pass therethrough and which are aligned along the length thereof. These openings may receive a key 20 which passes through an opening (or openings) 18 that passes completely through lower post section 10. The key 20 is inserted through the opening 18 and into any of the openings 14 defined through upper post section 12 such that the height of apparatus 1 may be temporarily and changeably fixed.

While the post member 8 of the apparatus 1 of the present invention has been described using only two post sections, it will be clear to one skilled in the art that the post 8 may advantageously be comprised of more than two sections, each subsequent section being sized to fit within a previous section, with the first post section being attached to the base 60 and the last post section having mounting frame member 3 attached to a free end thereof and each section defining openings 14 and 18 such that a key 20 may be used to temporarily and changeably fix the location of each such section relative to each previous section.

Preferably, all the post sections are formed from a rigid plastic or a lightweight metal alloy such as an aluminum alloy.

An arm member 4 is provided in the apparatus 1 of the present invention. A first end of arm member 4 is rotatably fixed to the mounting frame member 3 such that the arm is disposed in a generally parallel orientation relative to the surface upon which the apparatus 1 is placed and further the rotation thereof is about a substantially horizontal axis.

The arm member 4 is directed away from the post member 8 and base member 60 and the length of arm member 4 selected such that the volleyball 2 suspended from arm member 4 is spaced horizontally away from the apparatus 1 a sufficient distance to prevent the user of the apparatus 1 from colliding with the base member 60 or post member 8 when using said apparatus 1.

The arm member 4 is joined to mounting frame member 3 through the use of a plurality of pillow blocks and bearings 50 provided on mounting frame member 3, the pillow blocks being aligned and spaced far enough apart to provide stable rotation of arm member 4. The pillow blocks or other bearings which may be advantageously employed in the present invention are well known in the art and therefore will not be described in detail here.

A volleyball 2 is tethered to the rotating arm member 4 by a semirigid support 6. The support 6 is rigid enough so that the volleyball 2 will remain at a generally constant distance from the arm member 4 as the arm member 4 rotates after volleyball 2 is struck. However, the support 6 must be flexible enough to allow for some side to side motion when the volleyball 2 is struck.

A semi-rigid support arrangement of this type provides several advantages to the present invention. First, as pointed out above, the hallmark of making a skill 'second-nature' is repetition. With semi-rigid support 6, the volleyball 2 may travel along a substantially similar path each time it is struck. Therefore, the ball 2 will return to the same location as it was originally struck allowing the user to concentrate on the skill he is trying to learn rather than locating the ball.

Secondly, it is important, especially for individuals just learning the sport of volleyball, to hit the volleyball 2 squarely. Since, the support 6 has some flexibility, if the ball is not hit squarely, the support 6 will visibly bend to one side or the other. As a result, it will be readily apparent to the user or a coach observing the user that the volleyball 2 was miss-hit.

Thirdly, as a volleyball player becomes more skilled, he may desire to learn how to put a "spin" or "cut" on the ball. These techniques are useful when serving or spiking a volleyball and allow the striker to hit the ball in such a way as to put a "curve" on the balls trajectory. In the present invention, a "spin" or "cut" on the volleyball 2 would result in a small but visible bend or flex in the support 6 again allowing the user or a coach to see if the technique was properly performed by the user.

Figure 4:
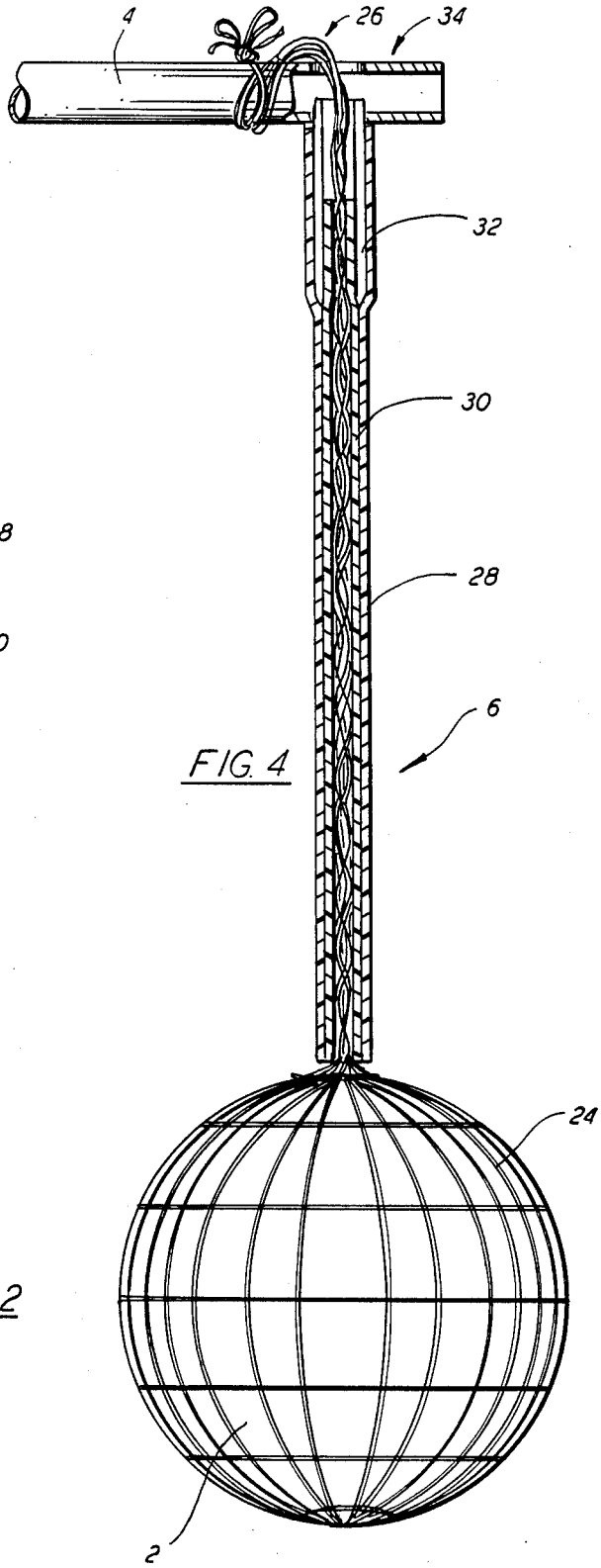
FIG. 4 is an enlarged, side view showing the attachment of the volleyball to the arm member of the present invention.
Figure 6:
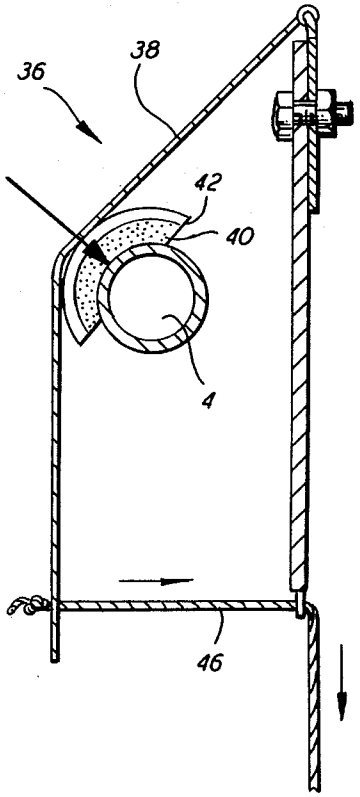
FIG. 6 is a cross-sectioned view of said brake means taken along line 6—6 of FIG. 5.
Figure 5:
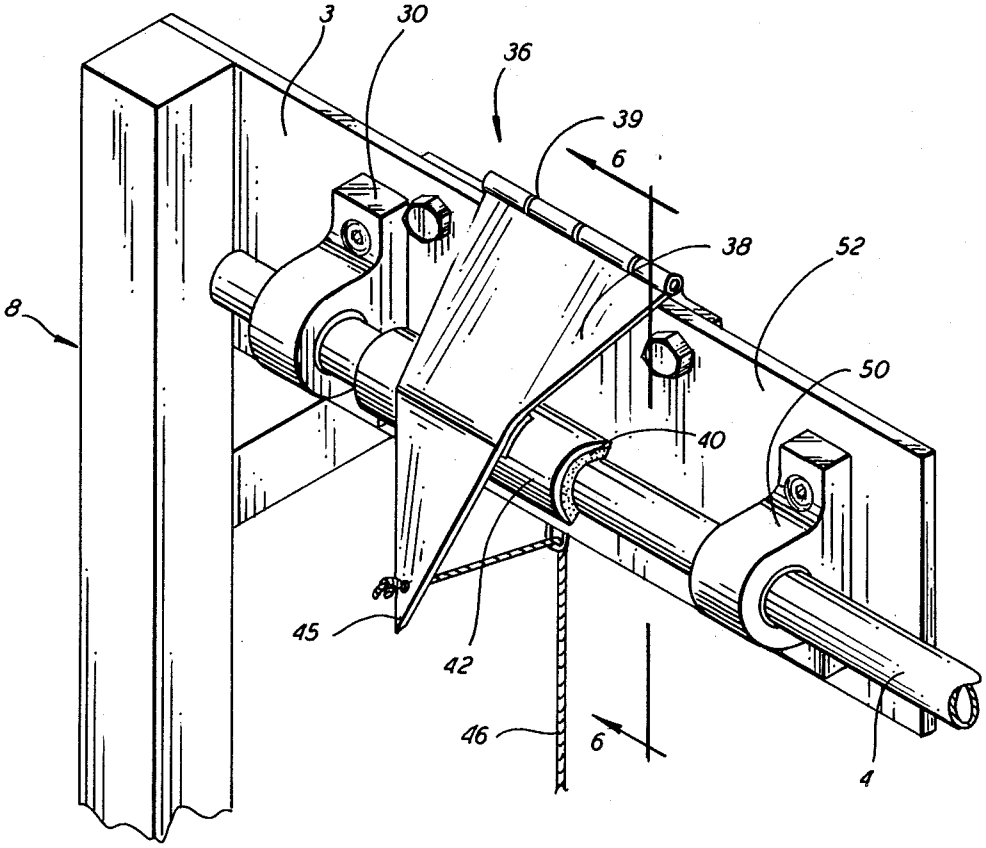
FIG. 5 is a fragmentary, top perspective view of the braking means of the present invention.

The above-described attributes and advantages are accomplished by a support 6 which is comprised of an oversized nylon net bag 24 having a drawstring 26 attached to the open end thereof, into which the volleyball 2 may be placed for attachment to arm member 4. Provided through an opening 34 defined adjacent to the free end of arm member 4 is a sleeve 32, prefereably metal, which is mounted in a generally perpendicular orientation to arm member 4. The end of sleeve 32 is received by a first hollow elongated tube member 28, a portion of which fits over and covers sleeve 32. A second hollow elongated tube member 30, which is inserted completely within first tube member 28 is received by sleeve 32 either in an abutting relationship or, as depicted in FIG. 4., second tube 30 may be received with the inside diameter of sleeve 32.

The volleyball 2 is joined to arm 4 by threading draw string 26 and the excess portion of the net bag 24 through tube members 28 and 30; through sleeve 32 and through opening 34 such that the draw string 26 may be fixed either by a tying or other suitable means to arm member 4. The size of net bag 24 and the length draw string 26 are selected such that volleyball 2 will be brought into a taut, abutting relationship with end of tube members 28 and 30.

The tube members 28 and 30 are preferably formed from any suitable tube material such as a polymer-based on like material. However, any material which imparts to support 6 the semi-rigid nature defined above may be suitably employed in the present invention and therefore, is within the scope of the present invention. In addition, it will be clear to one skilled in the art that instead of two separate tube members, a single tube member, having adequate thickness to provide the required semi-rigid nature of support 6 and being milled or machined to receive sleeve 32, may also be advantageously employed in the present invention and is, therefore, also within the scope of the invention.

In yet a more preferred embodiment of the present invention, brake means 36 are provided. The brake means allow a coach or user of the apparatus 1 to slow and/or stop the volleyball 2 after it has been struck. This results in the user being able to perform many more repetitions of the technique in a given amount of time, thereby making the present invention very useful in making such techniques "second nature" or cognative skills. In addition the ability to stop the movement of the volleyball 2 improves the safety of the apparatus 1 in that the volleyball 2 may be stopped before it strikes any unaware users or passerbys.

The brake means 36 of the present invention is comprised of a brake plate 38 having one edge 39 hingedly joined to the mounting frame member 3 such that said plate 38 extends over and may come in contact with a portion of said arm member 4. At the point of such contact said plate 38 is provided with a semi-circular tube member 42 rigidly fixed to said plate 38, said tube member 42 being sized and positioned to receive a portion of arm member 4. A friction enhancing material 40 may be provided along the portion of tube member 42 which contacts arm member 4. Finally, a flexible cord 46 is attached to the free end 45 of brake plate 38, the string having a handle 48 attached to the other end thereof. In operation, a user of the apparatus 1 may pull handle 48 which applies pressure to arm member 4 via tube member 42 and friction enhancing material 40 thereby slowing and/or stopping the rotation of arm member 4.

The apparatus 1 of the present invention may also be provided with a coaching cage 53 into which a coach or other individual may step and closely observe the user of the apparatus 1. The cage 53 is comprised of a first wall 56 which extends above base 60 in the same plane as post member 8. In addition, the cage 53 may comprise a second wall 54 extending perpendicular to said first wall along one edge said base 60 and a third wall 58 extending perpendicular to first wall 56 and along an opposite edge of base 60. As shown in FIG. 1 each wall is preferably of tubular construction and should be formed from a sufficient number of horizontal and vertical tube sections to provide adequate protection for the individual within the coaching cage 53 without detrimentally interferring with the occupier's view of the apparatus user.

Finally, the apparatus 1 of the present invention may be provided with wheels or casters 62 on a lower portion thereof (see FIG.1) to facilitate movement of the apparatus 1.

The apparatus 1 of the present invention has been described relative to the sport of volleyball. However, it will be clear to one skilled in the art that with very little modification the present apparatus may be adapted for use in teaching many of the skills used in other sports. These sports include, but are not limited to, basketball, football, soccer and the like. It is the applicant's belief that these modifications and changes which would be readily apparent to one skilled in the art and are therefore within the spirit and scope of this invention and are covered by the following claims.

What is claimed is:

1. An apparatus for use in teaching volleyball techniques, comprising:

support means supporting said apparatus in a substantial horizontal orientation at predetermined height above a surface;

an arm member having a first end rotatably supported by said support means such that said arm rotates about a substantially horizontal axis;

a ball; and means for semi-rigidly suspending said ball from a second end of said arm member.

2. The apparatus of claim 1 wherein the support means is comprised of:

a base member placed on a surface; and a post member having a first end joined to said base member such that said post member is supported in a generally upright position and a second end joined to said arm member, said post member extending above said surface.

3. The apparatus of claim 2 further comprising braking means such that the rate and duration of rotation of said arm member may be controlled.

4. The apparatus of claim 3 wherein the braking means is comprised of:

a brake plate having a first edge hingedly joined to fixed portion of said apparatus such that said plate extends over and may contact a portion of said arm member;

a semi-circular brake tube member fixed to said brake plate at the point of contact between said plate and said arm member, said brake tube being sized and positioned to receive a portion of said arm member;

a pull cord having a first end attached to said brake plate; and a friction enhancing member attached to the surface of said brake tube, such that when the pull cord is pulled, a stopping force is applied to said arm member via the brake plate, brake tube and friction enhancing material.

5. The apparatus of claim 2 wherein said post member is comprised of:

a plurality of elongated post sections connectible end-to-end in an aligned, non-rotative relationship, each post section being sized to receive the end of each subsequent post section such that the post member may be telescoped to a different height; each post section defining one or more holes along its entire length; and a key which may be inserted through said holes such that the relationship of each post section to the next may be fixed.

6. The apparatus of claim 5 wherein said post member is further comprised of three vertical walls joined and oriented in such a way as to form a cage into which a person may step and observe the user of said apparatus while being protected from the flight of said volleyball and the path of said user.

7. The apparatus of claim 2 wherein said semi-rigid support means is comprised of:

an oversized net bag which receives said ball, said bag having a draw string joined to the open end thereof;

a hollow sleeve rigidly fixed through an opening defined in said arm member;

a first, semi-rigid, elongated tube member having an inner diameter substantially equal to the outside diameter of said sleeve such that a first end of said first tube member may receive said sleeve; and a second, semi-rigid, elongated tube member having an outside diameter substantially equal to the outside diameter of said sleeve said second tube member being disposed entirely within said first tube member such that a portion of the draw string end of said net bag may be drawn through said first and second tube member and said sleeve such that said draw string may be tied around said arm member thereby fixing said ball and said apparatus.

8. An apparatus for use in teaching volleyball techniques, comprising:

a base member placed on a surface;

an extendable post member having a first end joined to said base member;

an arm member in a generally parallel orientation relative to said surface, having a first end rotatably supported by a second end of said post member such that said arm rotates about a substantially horizontal axis;

a ball;

an oversized net bag which receives said ball, said bag having a draw string joined to the open end thereof;

a hollow sleeve rigidly fixed through an opening defined in a second end of said arm member;

a first semi-rigid, elongated tube member having an inner diameter substantially equal to the outside diameter of said sleeve such that a first end of said first tube member may receive said sleeve;

a second, semi-rigid, elongated tube member having an outside diameter substantially equal to the outside diameter of said sleeve said second tube member being disposed entirely within said first tube member such that a portion of the draw string end of said net bag may be drawn through said first and second tube member and said sleeve such that said draw string may be tied around said arm member thereby fixing said ball and said apparatus;

a brake plate having a first end hingedly joined to fixed portion of said apparatus such that said plate extends over and may contact a portion of said arm member;

a semi-circular brake tube member fixed to said brake plate at the point of contact between said plate and said arm member, said brake tube being sized and positioned to receive a portion of said arm member;

a pull cord member having a first end attached to said brake plate;

a friction enhancing member attached to the surface of said brake tube, such that when the pull cord is pulled, a stopping force is applied to said arm member via the brake plate, brake tube and friction enhancing material; and three horizontal walls joined and oriented in such a way as to form a cage into which a person may step and observe the user of said apparatus while being protected from the flight of said volleyball and the path of said user.

* * * * *